US010610760B2

(12) United States Patent
Nowlan

(10) Patent No.: US 10,610,760 B2
(45) Date of Patent: Apr. 7, 2020

(54) WEIGHT CARRIER DEVICE

(71) Applicant: Daniel A. Nowlan, Arlington, TX (US)

(72) Inventor: Daniel A. Nowlan, Arlington, TX (US)

( * ) Notice: Subject to any disclaimer, the term of this patent is extended or adjusted under 35 U.S.C. 154(b) by 124 days.

(21) Appl. No.: 15/908,247

(22) Filed: Feb. 28, 2018

(65) Prior Publication Data

US 2018/0272223 A1 Sep. 27, 2018

Related U.S. Application Data

(60) Provisional application No. 62/477,234, filed on Mar. 27, 2017.

(51) Int. Cl.

| | |
|---|---|
| ***A63B 71/00*** | (2006.01) |
| ***A63B 21/072*** | (2006.01) |
| ***A63B 60/56*** | (2015.01) |

(52) U.S. Cl.

CPC ..... *A63B 71/0036* (2013.01); *A63B 21/0722* (2015.10); *A63B 60/56* (2015.10); *A63B 21/0726* (2013.01)

(58) Field of Classification Search

CPC ..... A63B 71/0036; A63B 21/0722; A63B 21/0726; A63B 60/56; B65D 23/10; B65D 23/104; B65D 1/0223; B65D 1/0246; B65D 1/0207; B65D 2501/0081; B65D 1/02; B65D 41/04; B65D 23/102; B65D 23/106; B65D 1/023; B65D 25/00; B65D 25/20; B65D 25/28

See application file for complete search history.

(56) References Cited

U.S. PATENT DOCUMENTS

| | | | | | |
|---|---|---|---|---|---|
| 221,001 | A * | 10/1879 | Stevens | B65D 23/104 | 215/242 |
| 677,824 | A * | 7/1901 | Troxler, Jr. | A63B 23/16 | 482/49 |
| 1,308,031 | A * | 7/1919 | Bell | A47F 5/01 | 211/49.1 |
| 1,329,989 | A * | 2/1920 | Mowery | B65D 23/104 | 220/6 |
| 1,337,010 | A * | 4/1920 | Frey | B65D 23/104 | 206/142 |
| 1,461,621 | A * | 7/1923 | Kranzl | B65D 23/104 | 294/33 |
| 1,474,322 | A * | 11/1923 | Ducorron | B65D 23/104 | 294/27.1 |
| 1,496,066 | A * | 6/1924 | Meyer | B65D 23/104 | 215/396 |

(Continued)

*Primary Examiner* — Andrew S Lo
(74) *Attorney, Agent, or Firm* — Law Office of Jeff Williams PLLC; J. Oliver Williams

(57) ABSTRACT

A weight carrying device having a pair of support bars, a detachable handle and a plurality of fasteners is presented herein. The support bars define a u-shape with a curved portion opposite opposing end. The support bar is made from a single member with the ends adjacent each other and opposite the curved portion. The handle in is communication with a first end of each of the support bars and is detachable to permit interchangeability. A plurality of fasteners are used to secure the handle to the ends of the support bars. The location of the handle may be adjusted along the length of the support bar. An optional pad in communication with the handle is provided to facilitate exercises and comfort to the user.

17 Claims, 3 Drawing Sheets

(56) References Cited

U.S. PATENT DOCUMENTS 1,625,210 A * 4/1927 Huntington ..... B65D 23/104 215/397
1,865,645 A * 7/1932 Schroder ..... B65D 23/104 206/446
2,038,139 A * 4/1936 Stanley ..... B65D 23/104 294/33
2,409,684 A * 10/1946 Jenkins ..... B65D 23/104 294/87.22
2,430,142 A * 11/1947 Roberts ..... A45F 5/10 294/168
2,814,491 A * 11/1957 Proctor ..... A63B 23/16 482/50
2,981,440 A * 4/1961 Lilja ..... B65D 71/0003 206/202
3,318,453 A * 5/1967 Cavanagh ..... B42F 17/08 211/11
D290,926 S * 7/1987 Embra ..... D8/14
4,681,315 A * 7/1987 Yang ..... A63B 21/0726 482/127
4,759,578 A * 7/1988 Gonzalez ..... B65G 7/12 294/137
D318,759 S 8/1991 Groves
5,496,243 A * 3/1996 Allen ..... A63B 21/0601 482/106
5,630,776 A 5/1997 Yang
6,321,910 B1 * 11/2001 Bates ..... B65D 67/02 206/449
6,692,415 B1 * 2/2004 Winston ..... A63B 21/0004 482/122
6,857,673 B2 * 2/2005 Lang ..... B65G 7/12 294/142
7,081,072 B2 * 7/2006 Allen ..... A63B 21/072 285/133.11
7,134,548 B2 11/2006 Meehan et al.
7,201,711 B2 * 4/2007 Towley, III ..... A63B 21/0605 482/106
7,473,213 B1 * 1/2009 Kallenbach ..... A63B 21/055 16/428
8,801,060 B1 * 8/2014 Smith ..... B65G 7/12 294/15
9,126,079 B2 * 9/2015 Jordan ..... A63B 21/072
9,409,049 B1 * 8/2016 Brunelo ..... A63B 21/078
10,441,838 B1 * 10/2019 Unger ..... A63B 21/0726
2014/0121075 A1 * 5/2014 Brown ..... A63B 21/026 482/106
2014/0274614 A1 * 9/2014 Newman ..... A63B 21/4035 482/139
2017/0127814 A1 5/2017 Mundy
2017/0136284 A1 * 5/2017 Meeker ..... A63B 21/0728
2017/0306605 A1 * 10/2017 Mendez ..... E03D 11/00
2019/0070480 A1 * 3/2019 Armstrong ..... A63B 71/0036

* cited by examiner

WEIGHT CARRIER DEVICE

CLAIM OF PRIORITY

This application claims the benefit of U.S. Provisional Application No. 62/477,234, filed 27 Mar. 2017. The information contained therein is hereby incorporated by reference.

BACKGROUND

1. Field of the Invention

The present application relates generally to a device for harnessing and carrying weights, and in particular to a device used to permit the carrying of multiple dumbbells with a single hand.

2. Description of Related Art

A focus on individual health is ever increasing. Many products and methods geared toward healthy eating and healthy living are produced each year. To live healthy, one area of concern is the exercise of the human body which may entail any activity requiring physical effort that is carried out to sustain or improve health and fitness. Exercise can be broken down to 4 different types: aerobic (cardio), strength, flexibility, and balance exercises. Aerobic and strength exercising are the most commonly thought of.

Aerobic relates to "oxygen" and its use when muscles generate energy during moderate-intensity physical activity. Good examples of aerobic exercise are swimming, cycling, rowing, jogging, brisk walking, cross country skiing, touch football and aerobics or 'cardio' classes at the gym. These exercises increase one's stamina. Conversely, strength training works one's muscles with some form of weight or 'resistance'. Examples include lifting free weights or using weight machines at a gym. It is in the use of free weights where selected disadvantages become evident.

With free weights, individual weights are provided at ever increasing weight values. These weights are generally in the form of plates for use with a bar, or in the form of a dumbbell. Naturally, the free weights are available at different weights. When using plates to exercise, multiple plates may be used at a time on the bar to precisely increase the weight incrementally. The ability to combine weights during a single use allows a person to acquire lighter weights in greater quantities and then combine them as necessary to reach their weight needs. Dumbbells don't provide this flexibility. Each dumbbell is operable within a single hand. To obtain greater weights for lifting, the person must purchase or find heavier dumbbells. The weights are not designed to combine for use as in the case with plates. Another disadvantage of dumbbells is that they are difficult to transport. Each dumbbell is carried one per hand. Some stands have been developed for holding dumbbells for storage but they fail to address: 1) how to transport multiple dumbbells per hand; and 2) how to exercise in a manner that allows for the use of more than one simultaneously per hand.

In one particular method, a device was developed to carry stacked dumbbells at a single time. This device used a singular curved rail to wrap under, around, and across the handles of the dumbbells. This design is limited in length, thereby not permitting adjustability in length of the rails to carry more than 2 dumbbells. Additionally, this design had a rigidly shaped handle area. A curved shape is not very ergonomic or comfortable. Additionally, different methods of exercises may require different handle shapes.

Although great strides have been made with respect to equipment and methods involved in strength training, considerable shortcomings remain. A device is needed to increase the flexibility of use with dumbbells by at least providing some modular control to the user by facilitating interchangeable grips/handles and the ability to potentially alter the length of the device.

SUMMARY OF THE INVENTION

It is an object of the present application to provide a weight carrier device configured to carry and use a plurality of dumbbells. The dumbbells are carried across the handle in a stacked configuration. The device of the present application is designed to handle weights of varied size and weight in any mixed configuration. This device permits the transportation of dumbbells more efficiently but also broadens the capabilities of a user to use the dumbbells in more exercises.

It is a further object of the present application that the device be configured to permit interchangeability of the handle. Handles affect the grip and comfort of the user as well as influence the type or manner of exercises that may be performed. The handles are interchangeable to allow a greater flexibility in exercises. An additional object of the present application is to provide an ability to lengthen the bars used to hold the dumbbells to permit a user to carrier two or more. As the size of dumbbells change depending on the total weight of the dumbbell, the mixing of dumbbells to achieve various combined weights can result in various overall heights for the dumbbells.

Ultimately the invention may take many embodiments. Use of this assembly increases functionality, permits greater use with various types of exercises, and adapts to various sized dumbbells. In this way, this device overcomes the disadvantages inherent in the prior art.

The more important features of the device have thus been outlined in order that the more detailed description that follows may be better understood and to ensure that the present contribution to the art is appreciated. Additional features of the device will be described hereinafter and will form the subject matter of the claims that follow.

Many objects of the present device will appear from the following description and appended claims, reference being made to the accompanying drawings forming a part of this specification wherein like reference characters designate corresponding parts in the several views.

Before explaining at least one embodiment of the system in detail, it is to be understood that the device is not limited in its application to the details of construction and the arrangements of the components set forth in the following description or illustrated in the drawings. The device is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present system.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
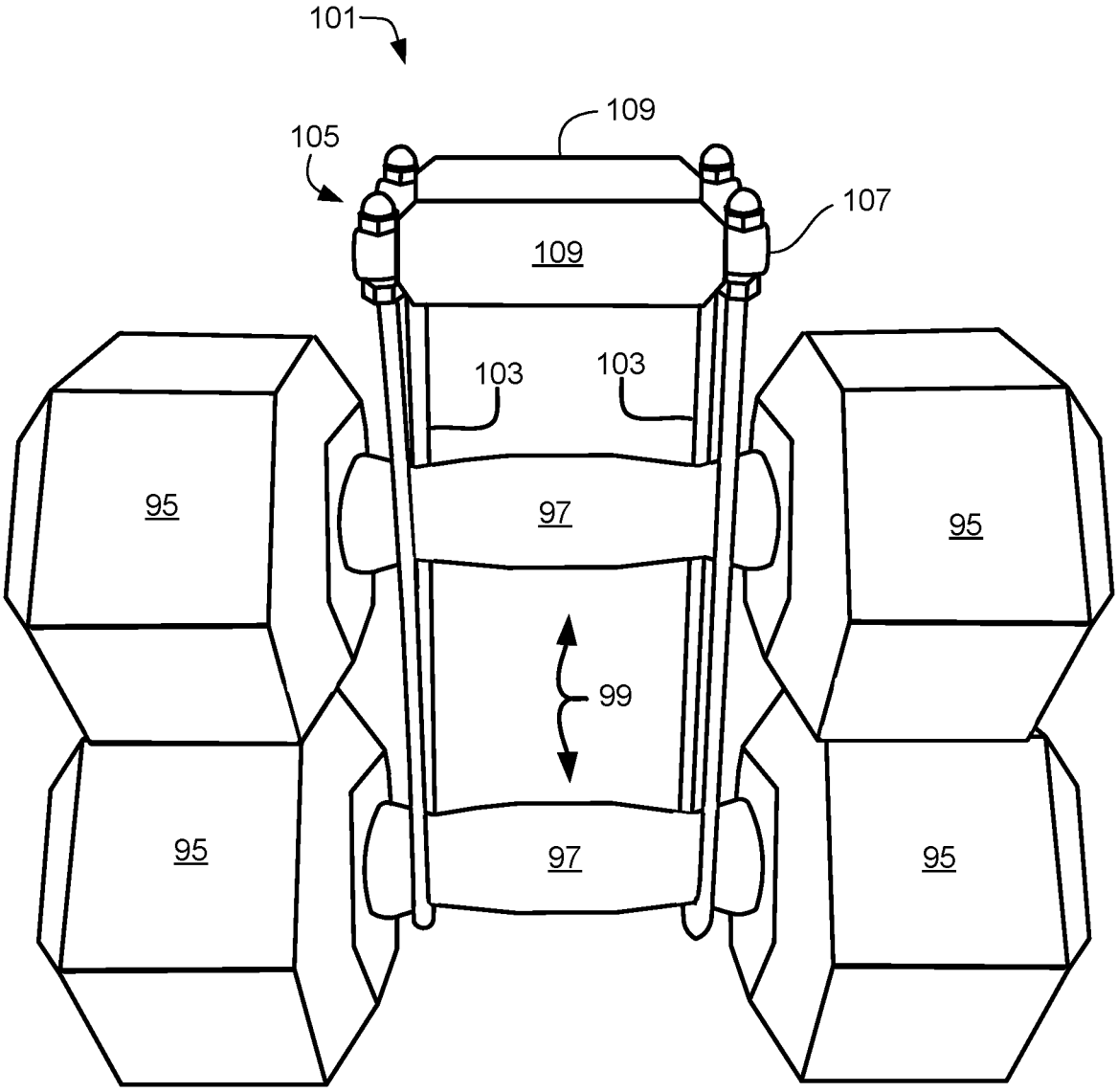
FIG. 1 is an exemplary perspective view of a weight carrier device according to an embodiment of the present application.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The device and method in accordance with the present application overcomes one or more of the above-discussed problems commonly associated with elevated platforms discussed previously. In particular, the device and method of the present application is configured to safely permit the stacking of dumbbells for use in different exercises as well as provide a more convenient manner of transporting. The device provides a singular gripping location for the combined dumbbells so as to allow a single hand to lift more than one dumbbell simultaneously. The weights may be carried or may be used to provide resistance training as desired. Interchangeable handles facilitate adaptability for different training methods and exercises. These and other unique features of the device are discussed below and illustrated in the accompanying drawings.

The device and method will be understood, both as to its structure and operation, from the accompanying drawings, taken in conjunction with the accompanying description. Several embodiments of the device may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The device and method of the present application is illustrated in the associated drawings. The device includes a plurality of support bars, a set of fasteners, a handle, and an optional pad. Two individual support bars are utilized, one at each end of the handle of the dumbbell. Each extends along a front side and rear side of the dumbbell while cupping under the lowest located dumbbell handle. A handle extends relatively parallel to the dumbbell handle and engages each support bar along a particular face. Fasteners are used to secure the interchangeable handle to the neighboring support bar ends. Additional features and functions of the device are illustrated and discussed below.

Referring now to the Figures wherein like reference characters identify corresponding or similar elements in form and function throughout the several views. The following Figures describe the device of the present application and its associated features. With reference now to the Figures, an embodiment of the modular observation device and method of use are herein described. It should be noted that the articles "a", "an", and "the", as used in this specification, include plural referents unless the content clearly dictates otherwise.

Figure 2:
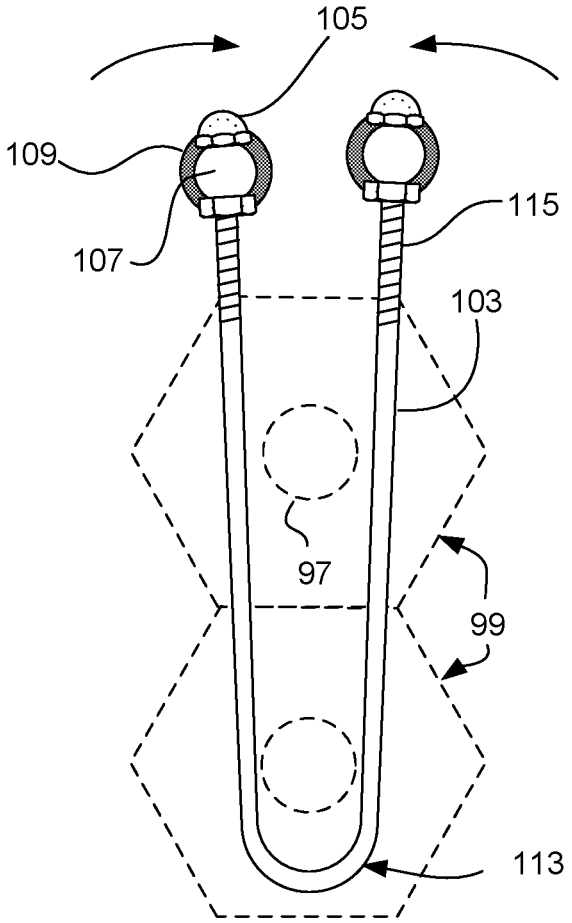
FIG. 2 is a side view of the weight carrier device of FIG. 1.
Figure 3:
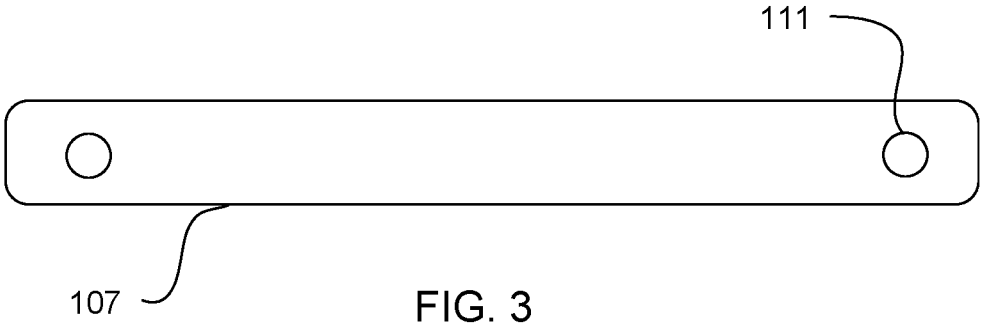
FIG. 3 is a top view of a handle in the weight carrier device of FIG. 1.

Referring now also to FIGS. 1-3 in the drawings, a weight carrier device 101 is illustrated. Device 101 is shown engaged with two dumbbells 99 in FIG. 1. Device 101 includes a plurality of support bars 103, a set of fasteners 105, a handle(s) 107, and an optional pad(s) 109. The plurality of support bars are coupled together through the fasteners 105 and handles 107.

To give context to the description of device 101 and its method of use, a brief discussion related to dumbbells 99 is instructive. Dumbbells 99 are hex dumbbells that include two hex ends that are selectively coated on the ends 95 to prevent damage from the weight. Each dumbbell includes a handle 97 that extends between the opposing weighted ends. The circumference of the ends of each dumbbell extend beyond the circumference of handle 97. The hex ends allow for the relatively easy stacking of the dumbbells on each other or within a typical stand for display and organization. It is understood that the shapes and stackability of the dumbbells may differ between various styles. The height variation of the ends relative to the handle 97 directly affect the ability of a person to handle more than one dumbbell simultaneously in a single hand. Note that the coating on ends 95 are optional as well as the shape. Octagonal shaped ends are also common.

Device 101 is configured to include support bars 103 designed to wrap underneath handles 97. At least two support bars 103 are used. Each support bar includes two vertical linear portions joined through a curved portion 113. The curved portion defines a u-turn and is used primarily to engage and contact handle 97 of the lowest dumbbell 99 in the stacked configuration of dumbbells. Each vertical linear portion of support bars 103 passes along different sides of handle 97, such as a front side and rear side of the dumbbell 99 while cupping under the lowest located dumbbell handle. Each support bar 103 has opposing ends relatively adjacent one another (due to curved portion 113) that are opposite that of curved portion 113.

When not in use, support bars 103 are allowed to drop relative to handle 97 such that a central curved portion 113 of support bar 103 is not in contact with the handle of the dumbbell 99. When in use, portion 113 is brought upward and contacts handle 97. Of note is that the relative angle between the vertical linear portions of support bars 103 is small enough to keep those vertical linear support portions inside the outer circumference of ends 95. The distance between the vertical linear portions may be adjusted by changing their angle relative to one another and by changing the radius of curved portion 113.

The stacking feature of dumbbell 99 makes it easy for the dumbbells to remain stacked when resting on a surface. This feature also helps to maintain a constant and stable orientation while being carried by support bars 103. It is understood that the ends 95 of dumbbells 99 may be any shape and that such shape does not impact the functions and features of the present device 101.

Each support bar 103 is located adjacent to a particular end 95 and independent from each other. Each support bar 103 is configured to wrap around both sides of handle 97 and cradle it. This is seen in FIGS. 1 and 2. Handles 107 are configured to couple the ends of two or more support bars together on opposite sides of dumbbells 99. As seen in the Figures, an exemplary representation of this occurring is to have handle 107 extend across and communicate with neighboring ends of each support bar 103 along the same side of dumbbell 99. These ends are located on the same side of handles 95. This leaves a gap for the passage of handles 97 to slide between the vertical linear portions of each support bar 103. The gap is easily seen from FIG. 2 where a side view is represented. Therefore each dumbbell may be inserted or removed without the need to disassemble any portion of device 101. FIG. 3 shows an exemplary embodiment of handle 107 for this purpose.

Figure 4:
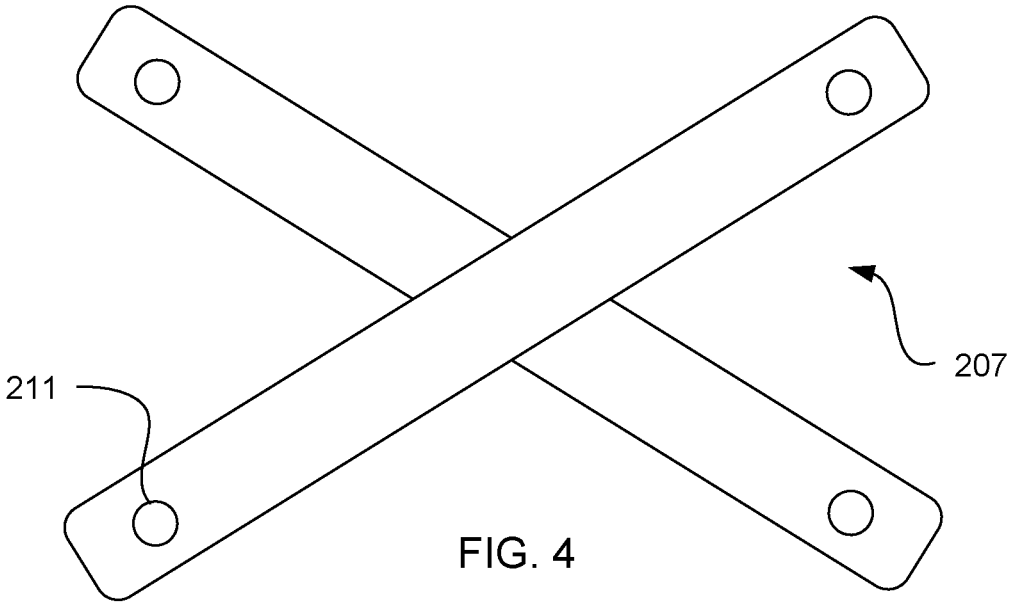
FIG. 4 is a top view of an alternate embodiment of the handle of FIG. 3.

Referring now also to FIG. 4 in the drawings, an alternate embodiment of handle 107 is illustrated. Handle 207 is similar in form and function to that of handle 107. Handle 207 also is used to secure or couple a plurality of ends of support bars 103 together. Handle 207 is configured to couple to a plurality of opposing ends of each support bar 103 on both sides of dumbbells 99 at apertures 211. In this type of configuration, part of handle 207 would extend across the vertical plane defined by handles 107. This set up could help secure dumbbells 99 in device 101 to prevent removal. Removal of dumbbells 99 would therefore necessitate at least a partial removal of handle 207. In both embodiments, handles 107/207 are removable from support bars 103 to permit their interchangeability to allow users to adjust for the sake of comfort or in accordance with the needs of a particular exercise.

Handles 107 include an aperture 111 for the passage and acceptance of support bars 103. Support bars 103 have a threaded portion 115 near the top of each vertical linear portion for the acceptance of fasteners 105. Fasteners 105 are configured to locate and secure handle 107 relative to each support bar 103 via interference fit. As seen in FIG. 2, fasteners 105 may be located above and/or below handle 107. Wherein the upper fastener closest to the end of the vertical linear portion is not capped, fasteners 105 may be used to locate handle 107 to a set or desired height along the length of each vertical linear portion. This allows device 101 to accommodate for different sized dumbbells 99 and permits the user to adjust the distance between the curved portion 113 and handle 107. As seen in FIG. 2, a lower fastener is shown (uncapped) and an upper fastener is shown (capped). In this adjustable configuration, any number of capped or uncapped fasteners may be used to regulate the locating of handle 107.

As seen clearly in FIG. 2, handle 107 is tubular in shape. It is understood that handle 107 is not limited to such shape and may include any number of different contours and surface etchings to aid in ergonomic comfort and improved grip. Additionally, handle 107 is able to be configured with either a rigid structure or be configured with a pliable or flexible construction.

Additionally, pads 109 may be included and configured to ergonomically comfort the user while using device 101. Pad 109 is optionally associated with handle 107. As seen in FIG. 1, an ideal configuration would be to use pad 109 across the entire length of handle 107 so as to provide support to the entire palm of the hand. Special contouring and material selection may be made or provided to increase comfort and function.

Figure 5:
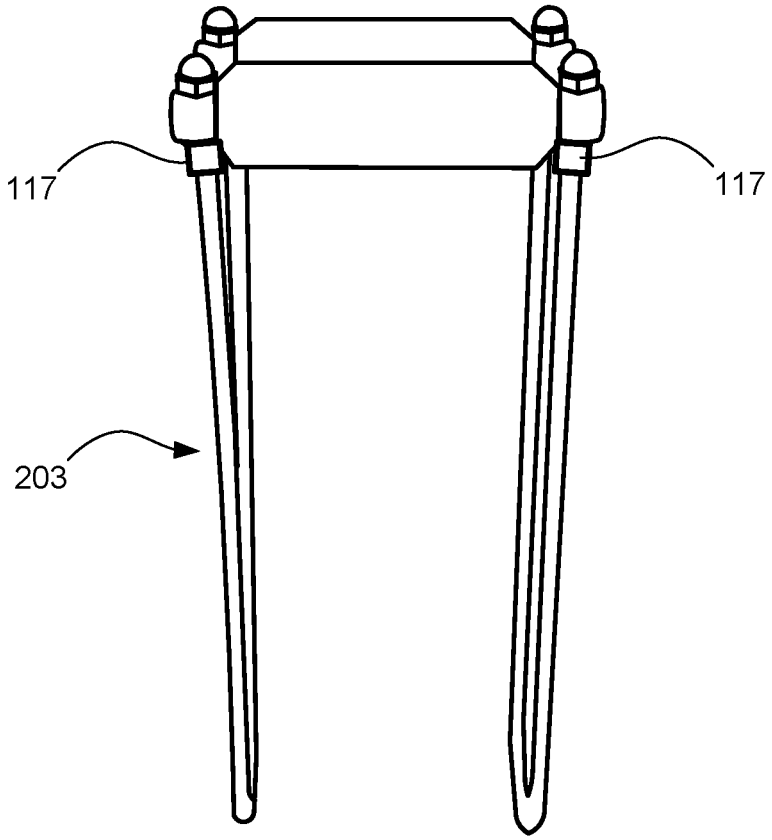
FIG. 5 is an alternate embodiment of a support bar in the weight carrier device of FIG. 1.

Referring now also to FIG. 5 in the drawings, an alternative embodiment to support bars 103 is illustrated. Support bars 203 are similar in form and function to that of support bars 103 except as herein provided. It is preferred that support bars 103 are designed to be easily manufactured without the need for special add-ons beyond the simple tubular shape that is formed to create the two vertical linear portions joined by curved portion 113. In other words, other embodiments of device 101 may include a flange or stop 117 integrally formed onto bar 103 below handles 107 at some location (See FIG. 5). This is seen in support bar 203. This advantage is to eliminate the need of the lower fastener and provide increased support. However this would act to limit the adjustability present with dual fasteners and threaded portion 115. This would also increase costs to manufacture. Such similar add-ons are permitted and possible with the design of device 101 but are not necessary.

It is also understood that by removing fasteners 105, support bars 103 and/or handles 107 may be interchanged. This is useful where a user may prefer different grip through pads 109 for particular weight combinations or types of exercises. Also, different diameters of handles 107 may be used and therefore interchanged depending on the hand size of the user. Likewise, where the outer circumference of ends 95 are substantially smaller with lighter weight dumbbells, a user may need to select or interchange bars 103 such that curved portion 113 has a smaller radius to ensure that the vertical portion of support bars 103 remain within ends 95. The opposite is equally true with heavier dumbbells.

A feature of device 101 is the ability of bars 103 to gently flex inward and outward as seen in FIG. 2. When gripped by a user, the hand of the user reaches around both handles 107. Handles 107/pads 109 are configured to permit contact between one another. By allowing the handles 107 to flex inward, the ability of the user to grip both handles with a single hand increases. This is to prevent the dumbbells from slipping out. Although shown with two dumbbells, it is understood that device 101 may be configured to carry more than two dumbbells. The size and weight of the dumbbells in combination with the strength of the user are a determining factor in the number to be carried.

In use, a user may elect to merely carry a plurality of dumbbells or may elect to exercise with a plurality of dumbbells. When carrying only, the user grabs and selectively passes the handles of the dumbbells through the gap between handles 107. When using device 101 to exercise, the user may elect to perform various actions. For example, the user selects the appropriate weights. The user combines a plurality of dumbbells to arrive at the desired weight level. The user inserts the desired weights through the gap. The user may interchange any of pads 109, handle 107, and bar 103 to accommodate the particular need. The user may grab handle 107 with a single hand and perform the exercise. It is understood that a user may also place two hands across handles 107 to perform an exercise. For example, using two hands with device 101 may allow a user to perform exercises reserved for a kettlebell.

In both use situations above, the user obtains a pair of support bars 103 and locates the curved portion 113 under a first dumbbell 99. The user may then stack one or more additional dumbbells 99 on adjacent the existing dumbbell. The support bars 103 are selected in accordance with the desired length and curvature for the task. The handle 107/207 may be selected as needed as well and interchanged or located on the support bars 103 at any time before or after insertion of dumbbells 99.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A weight carrying device, comprising:

a first support bar defining a u-shape with a first curved portion, the first support bar having opposing ends adjacent each other and opposite the first curved portion;

a second support bar defining a u-shape with a second curved portion, the second support bar having opposing ends adjacent each other and opposite the second curved portion;

a first handle coupled to a first end of each of the first support bar and the second support bar;

a second handle coupled to a second end of each of the first support bar and the second support bar; and a plurality of fasteners to secure the first handle and second handle, the plurality of fasteners permitting interchangeability of the first handle and the second handle.

2. The device of claim 1, wherein the first handle is parallel to the second handle.

3. The device of claim 1, wherein the first handle and the second handle are located proximate to each other for grasping by a single human hand.

4. The device of claim 1, further comprising:

a pad coupled to a portion of at least one of the first handle and the second handle.

5. The device of claim 4, wherein each handle includes a pad, the pad on each handle is shaped the same.

6. The device of claim 4, wherein each handle includes a pad, the pad on each handle is different.

7. The device of claim 1, wherein the first support bar and the second support bar each define a length between their respective curved portion and respective opposing ends.

8. The device of claim 1, wherein the plurality of fasteners are configured to locate the first handle to a position along a length of the first support bar.

9. A weight carrying device, comprising:

a first support bar defining a u-shape with a first curved portion, the first support bar having opposing ends adjacent each other and opposite the first curved portion;

a second support bar defining a u-shape with a second curved portion, the second support bar having opposing ends adjacent each other and opposite the second curved portion;

a handle coupled to one end of the first support bar and one end of the second support bar; and a plurality of releasable fasteners to secure the handle to the respective ends;

wherein the first support bar and the second support bar each define a length between their curved portion and respective opposing ends; and wherein the first support bar and the second support bar each include a threaded portion for engagement by the plurality of releasable fasteners, the plurality of releasable fasteners configured to translate along the threaded portion so as to adjust the distance between the handle and the first curved portion and the second curved portion.

10. The device of claim 9, wherein the handle is removable from the first support bar and the second support bar.

11. The device of claim 9, wherein the handle is tubular in shape.

12. The device of claim 9, wherein the handle is flexible.

13. The device of claim 9, further comprising:

a pad coupled to a portion of the handle.

14. A method of carrying a plurality of dumbbells, comprising:

obtaining a weight carrying device having:

a pair of support bars comprising a first support bar and a second support bar each having a curved portion forming a u-shape, the pair of support bars having opposing ends adjacent one another opposite that of the curved portions;

a first handle releasably coupled to a first end of each of the first support bar and the second support bar;

a second handle releasably coupled to a second end of each of the first support bar and the second support bar; and a plurality of fasteners to secure the first handle and second handle, the plurality of fasteners permitting interchangeability of the first handle and the second handle;

locating the curved portions under a first dumbbell;

selecting the first handle and the second handle for coupling between ends of the pair of support bars; and grasping the first handle and the second handle with a single hand to move the first dumbbell.

15. The method of claim 14, further comprising:

securing the first handle and the second handle to the respective first or second ends of the pair of support bars with the plurality of fasteners.

16. The method of claim 14, further comprising:

interchanging the first or second handle to accomplish a task.

17. The method of claim 14, further comprising:

interchanging at least one of the pair of support bars.

* * * * *